US005611395A

United States Patent [19]

Kang et al.

[11] Patent Number: 5,611,395

[45] Date of Patent: Mar. 18, 1997

[54] FIN FOR HEAT EXCHANGER

[75] Inventors: Jong K. Kang, Seoul; Sang H. Jeong, Kyungsangnam-do; Kam K. Lee; Tae W. Kang, both of Busan-si; Jeom Y. Yun, Kyungki-do, all of Rep. of Korea

[73] Assignee: LG Electronics Inc., Seoul, Rep. of Korea

[21] Appl. No.: 542,407

[22] Filed: Oct. 12, 1995

[30] Foreign Application Priority Data

Feb. 22, 1995 [KR] Rep. of Korea ..... 3432/1995

[51] Int. Cl.[6] ..... F28D 1/04; F28F 1/32

[52] U.S. Cl. ..... 165/151; 165/182; 165/DIG. 502

[58] Field of Search ..... 165/151, 182

[56] References Cited

U.S. PATENT DOCUMENTS 5,042,576 8/1991 Broadbent ..... 165/151
5,109,919 5/1992 Sakuma et al. ..... 165/151
5,170,842 12/1992 Kato et al. ..... 165/151
5,360,060 11/1994 Tanaka et al. ..... 165/151

FOREIGN PATENT DOCUMENTS 2-136696 5/1990 Japan ..... 165/151

*Primary Examiner*—Allen J. Flanigan
*Attorney, Agent, or Firm*—Fish & Richardson PC

[57] ABSTRACT

A fin for a heat exchanger is disclosed including tubes through which thermal fluid flows; first and second rectangular slits disposed in the fin sequentially from a central line connecting the centers of the tubes, both ends of the slits being in parallel with an air incoming direction; and a third slit having a predetermined plane angle at its outer end adjacent to the tubes in order to reduce vortex flow produced at the rear of the tubes.

3 Claims, 8 Drawing Sheets

F. I G.1
prior art
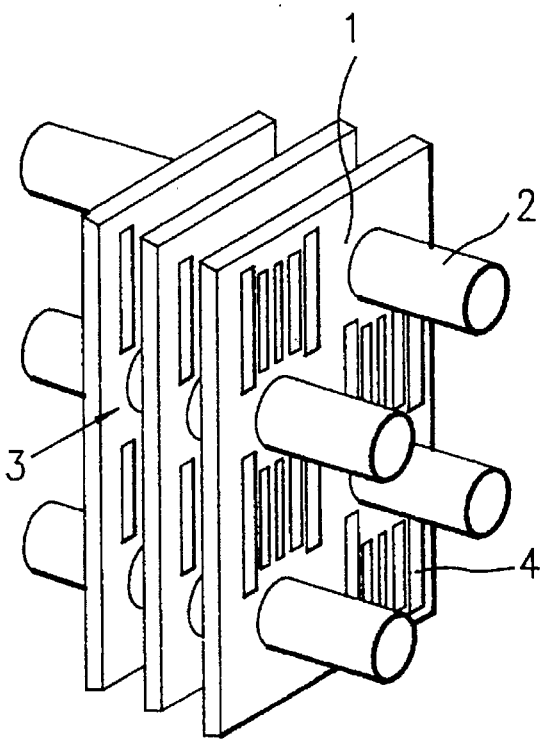
F. I G.2
prior art
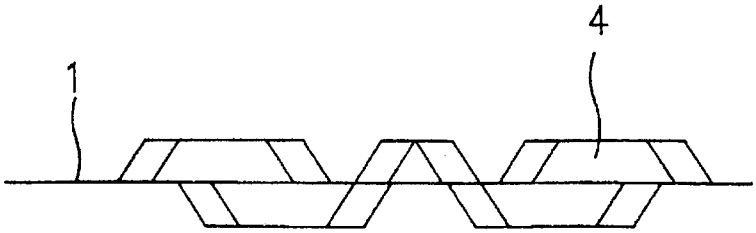

F. I G.3
prior art
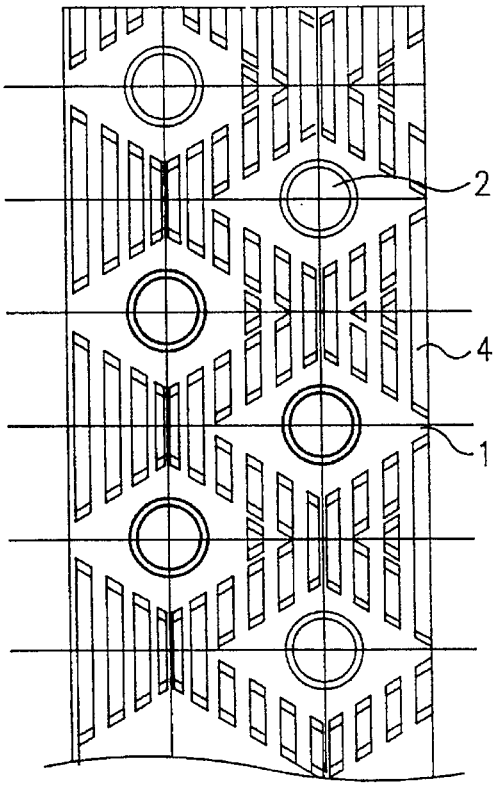
F. I G.4
prior art
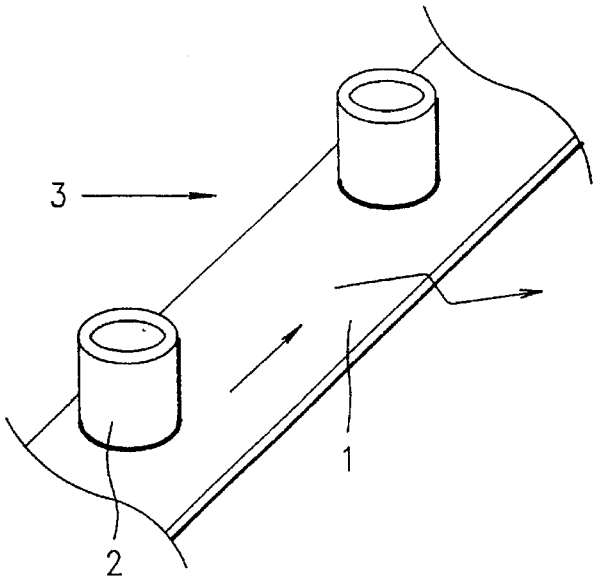

FIN FOR HEAT EXCHANGER

BACKGROUND OF THE INVENTION

The present invention relates to a fin for a heat exchanger, and more particularly, to a fin for a heat exchanger for emitting heat from a thermal fluid flowing through a tube.

As shown in FIGS. 1, 2 and 3, a conventional heat exchanger has fins 1 and tubes 2. A plurality of slits 4 protruding up or down from fin 1 are formed to increase heat transfer with the air 3. The heat exchanger of FIG. 3 is disclosed from Korean Patent Application No. 88-14083.

Despite the demand for minimization and high performance of heat exchangers, air running speed between fins 1 is kept low to minimize noise. In the heat exchanger, the thermal resistance of the fin-surface gas is much higher than that of the internal gas. For this reason, the surface area of fin 1 is increased to reduce the difference between the thermal resistances of the external and internal gases. However, there is a limit to increasing the surface area of fin 1. At present, the thermal resistance of the fin surface far surpasses the internal thermal resistance of tube 2. Condensed water formed on the surface of the fins amplifies the thermal resistance of the external gas, decreasing the efficiency of the heat exchanger.

FIG. 4 shows a process of transferring heat of the heat exchanger from tube 2 to the air through fin 1. Heat is transmitted to fin 1 due to conduction from tube 2. By convection with air, heat is emitted from tube 2 and fin 1 to air, performing as a refrigeration load.

A heat exchanger's performance is determined by conduction and convection heat transfer. However, the conventional technology shown in FIG. 3 has the following disadvantages. Condensed water is hard to discharge due to the complicated shapes of the slits on the fin base. This decreases its heat transfer performance. In addition, a plurality of slits inhibit smooth air flow. Accordingly, the input loss at the front end of the heat exchanger is increased raising the fan load of the air conditioning unit.

SUMMARY OF THE INVENTION

Therefore, it is an object of the present invention to provide a fin for a heat exchanger which improves the heat transfer characteristic on the air side of the heat exchanger and facilitates the discharging of condensed water.

To accomplish the object of the present invention, there is provided a fin for a heat exchanger comprising tubes through which thermal fluid flows; first and second rectangular slits disposed sequentially from a central line connecting the centers of the tubes, both ends of the slits being in parallel with an air incoming direction; and a third slit having a predetermined plane angle at its outer end adjacent to the tubes in order to reduce vortex flow produced at the rear of the tubes.

BRIEF DESCRIPTION OF THE ATTACHED DRAWINGS

FIG. 1 is a perspective view of a conventional fin of a heat exchanger;

FIG. 2 is a side sectional view of the conventional fin;

FIG. 3 shows one example of the shape of a conventional slit of the fin;

FIG. 4 illustrates a general path of heat transfer;

DETAILED DESCRIPTION OF THE INVENTION

Figure 5:
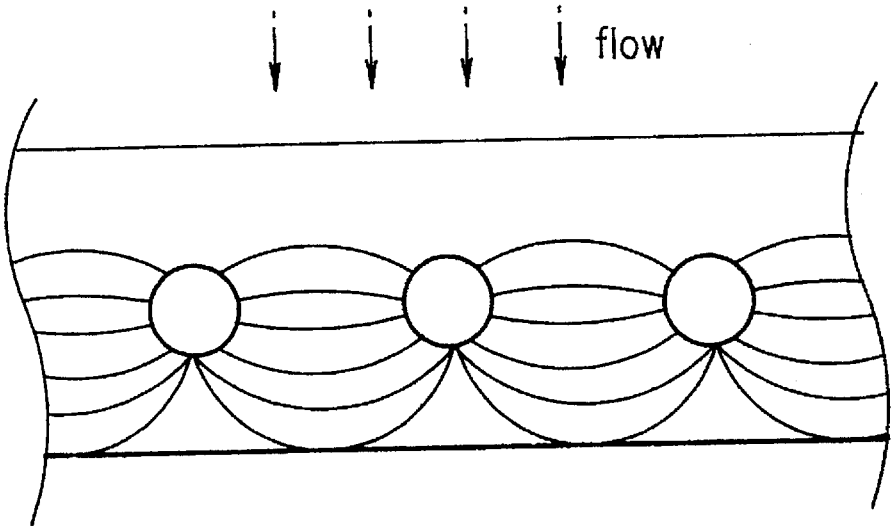
FIG. 5 illustrates a heat flow when air is applied.

Referring to FIG. 5, when air flows in the direction of the arrow, conduction and convection occur on the fin at the same time so that the flow of heat is bent at the rear of the flow of air.

A configuration of the present invention will be described with reference to FIGS. 6–9. In these drawings, given a central line connecting the center of the tubes, the nearest slit from the central line is called the first, the next slits the second and third.

Figure 6:
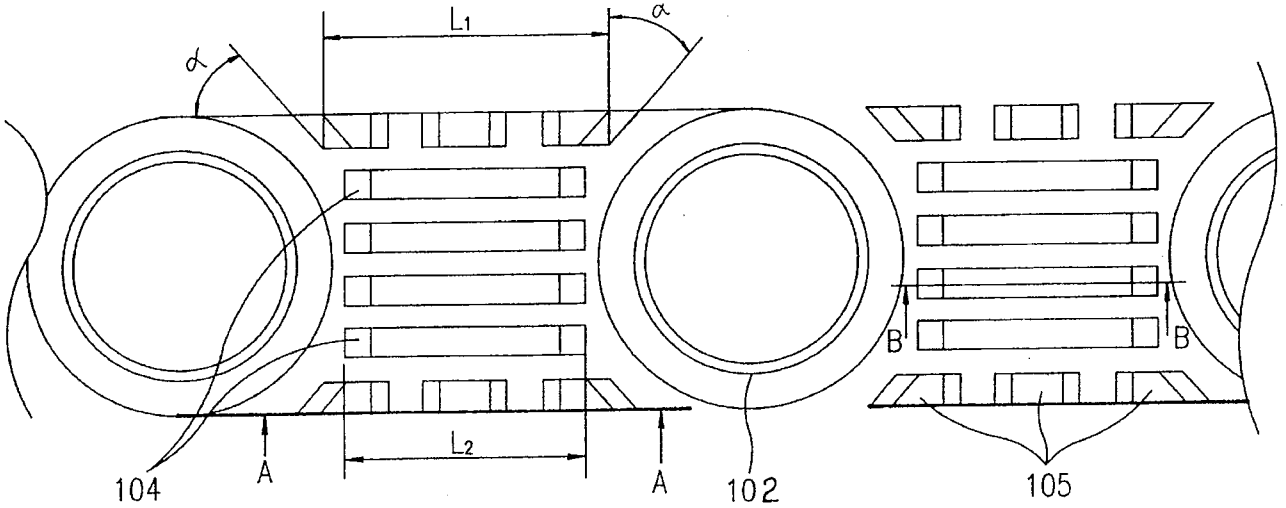
FIG. 6 illustrates a plane configuration of a fin of a heat exchanger of the present invention.

First and second rectangular slits 104 are formed in parallel with the flow of heat shown in FIG. 6. Third slit 105 divided into three portions forms a plane angle $\alpha$ of 30°–50° at the outer end adjacent to the tube in order to reduce vortex flow produced at the rear of the flow of tube 102. The height $L_3$ of slits 104 and 105 is 0.7–0.9 mm. The outer end of third slit 105 and both ends of first and second slits 104 form sectional angle $\gamma$ of 35°–42°. The sectional angle $\beta$ of the inner end of third slit 105 is 27°–35°. The length $L_1$ of third slit 105 is supposed to be greater than length $L_2$ of first and second slits 104.

In another embodiment of the present invention, third slit 205 is divided into two portions. The sectional angle $\gamma$ of one side is 35°–42°. The sectional angle $\beta$ of the other side is 27°–35°. The effect of the present invention will be presented with reference to FIGS. 10, 11 and 12.

Figure 7A:
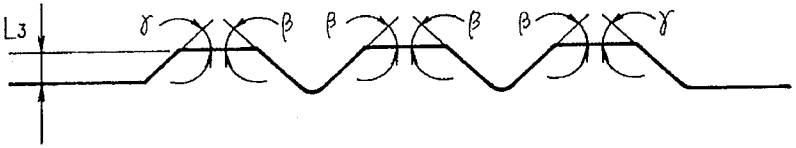
FIG. 7A is a cross-sectional view of FIG. 6 cut along line A—A.
Figure 7B:
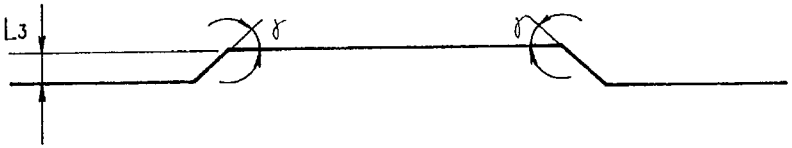
FIG. 7B is a cross-sectional view of FIG. 6 cut along line B—B.
Figure 8:
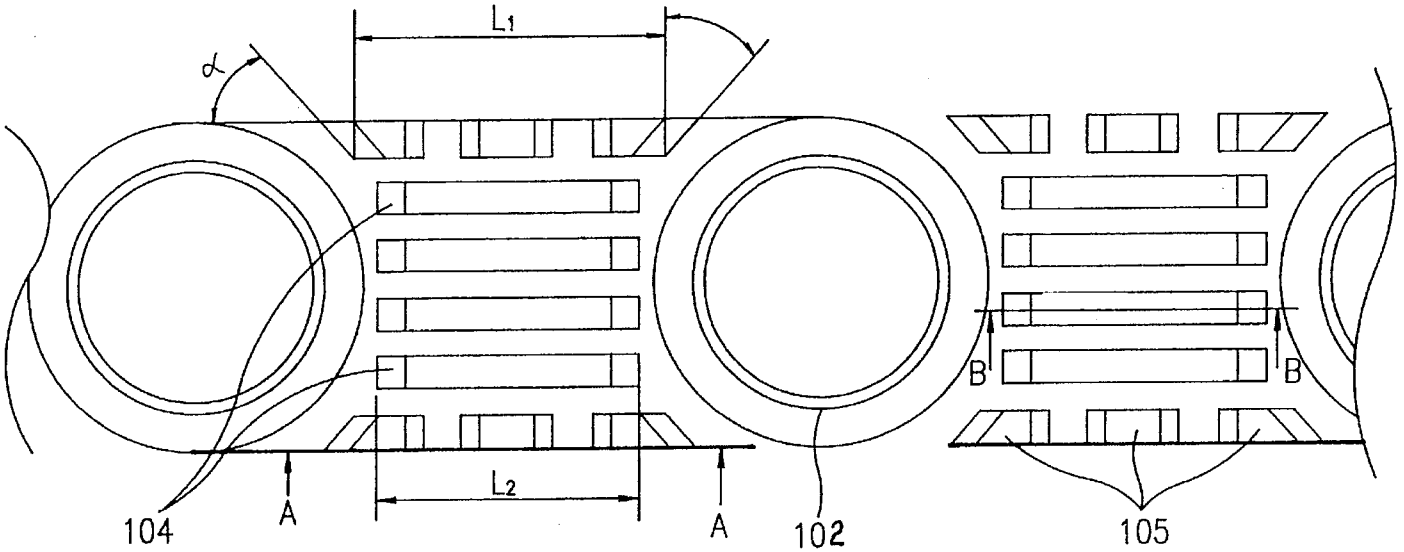
FIG. 8 illustrates another embodiment of the fin of the present invention.
Figure 9:
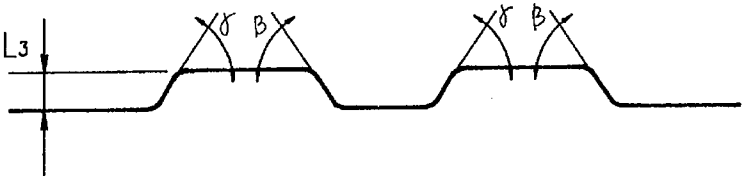
FIG. 9 is a cross-sectional view of FIG. 8 cut along line C—C.

Rectangular first and second slits 104 whose ends are in parallel with the flow of air have the same length $L_2$, minimizing pressure reduction caused due to air flow. The side sectional shape of third slit 105 reduces the vortex flow of the wake zone produced when the air flow passes through the slits on the fin. The combinations of first and second slits 104 and third slit 105 shown in FIGS. 6, 7 and 8 are not complicated, thereby facilitating the discharge of condensed water and increasing the mixing of turbulent flows.

Figure 10:
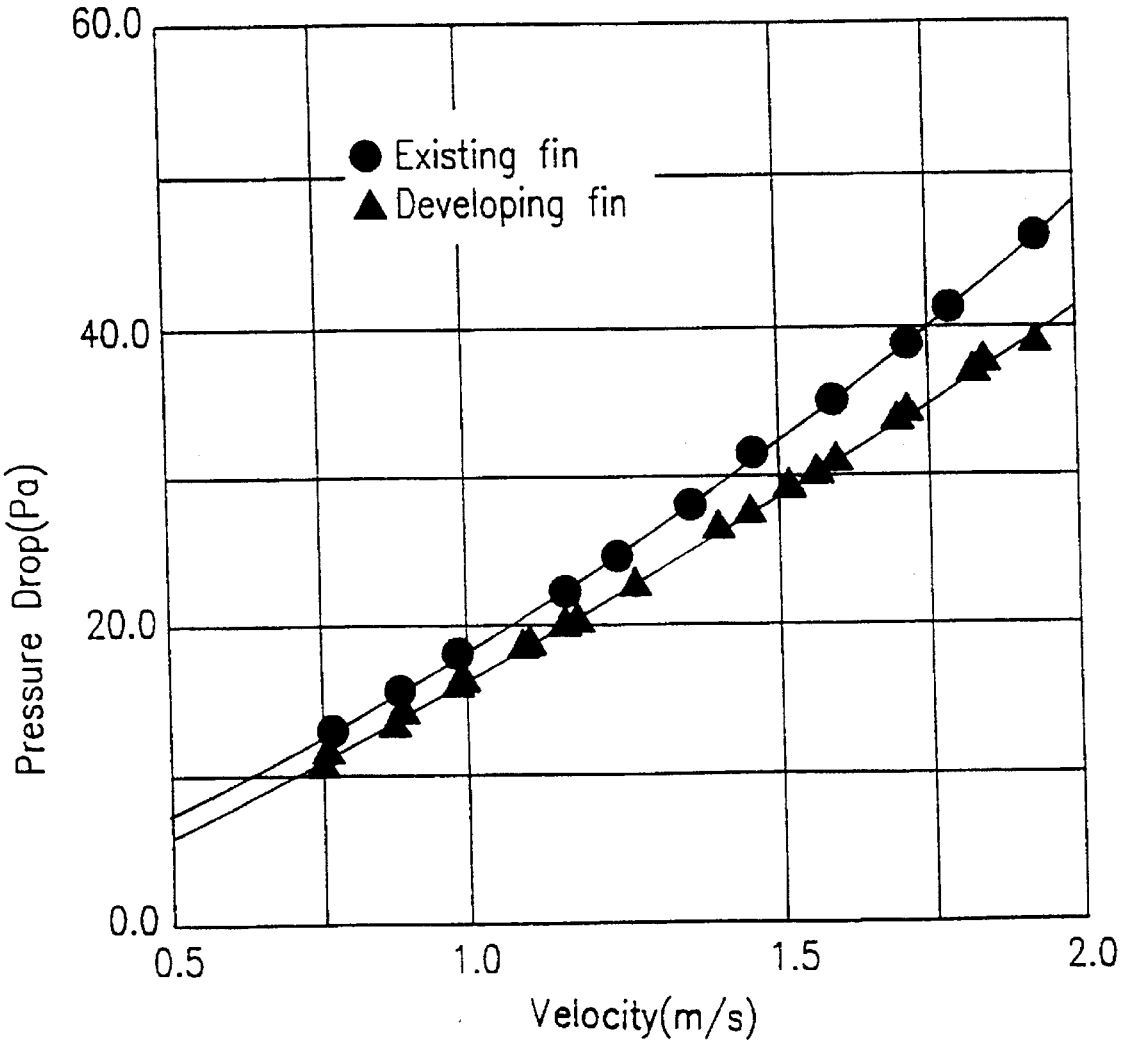
FIG. 10 illustrates a comparison of press loss between the present invention and the prior art.

Referring to FIG. 10, the present invention has a pressure loss lower than that of the prior art, reducing the fan load. As a result, the present invention is superior to the prior art in having a lower noise level.

Figure 11:
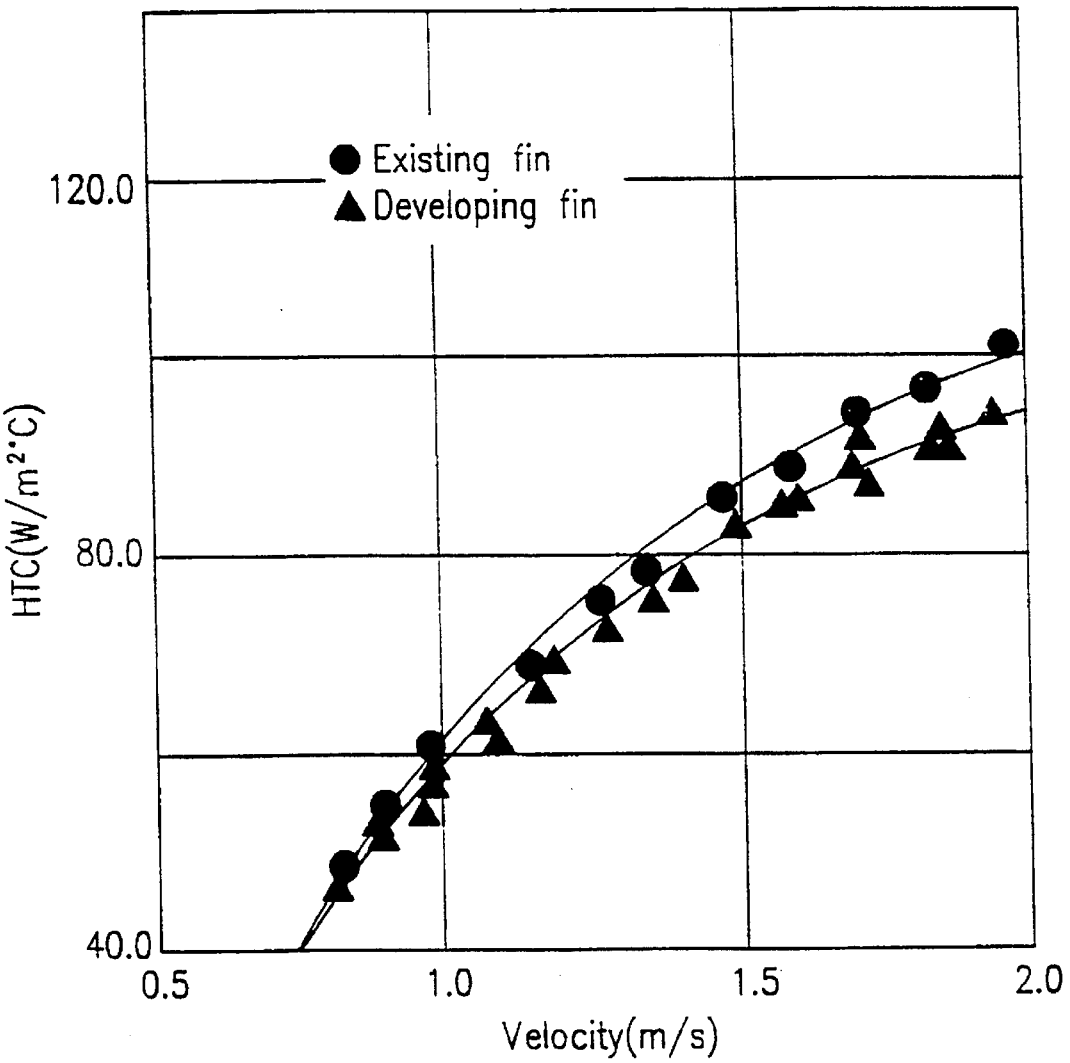
FIG. 11 illustrates a comparison of heat transfer coefficient with an air running speed between the present invention and the prior art.
Figure 12:
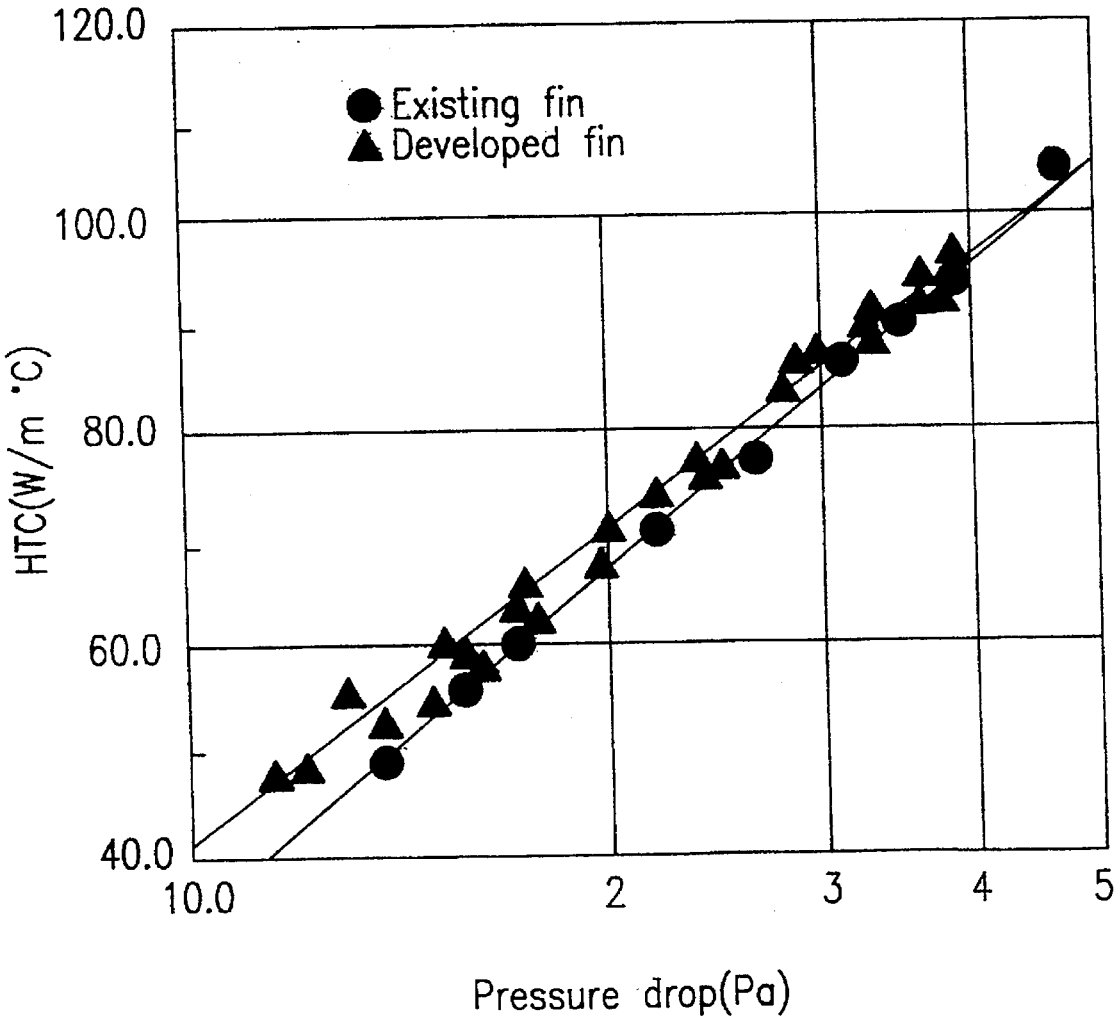
FIG. 12 illustrates a comparison of heat transfer coefficient with pressure loss between the present invention and the prior art.

Referring to FIG. 11, the present invention has a lower heat transfer coefficient than that of the prior art in the overall portion of the flow. However, turning to FIG. 12, the fin of the present invention has a heat transfer coefficient higher than that of the prior art at the same pressure loss. Therefore, the heat transfer characteristic can be enhanced by replacing the fin of the prior art with that of the present invention.

As described above, the present invention enhances the air-side heat transfer characteristic and facilitates the discharging of condensed water. In addition, fan power requirement and noise are reduced.

What is claimed is:

1. A fin for a heat exchanger comprising: tubes through which thermal fluid flows:

fins into which said tubes are inserted vertically;

first and second rectangular slits disposed on said fins sequentially from a central line connecting the centers of said tubes, the height of said slits being 0.7–0.9 mm and both ends of said slits forming the sectional angle of 35°–42° to the plane of the fins and both ends of said slits being in parallel with an air incoming direction; and a third slit having a predetermined plane angle at its outer end adjacent to said tubes in order to reduce vortex flow produced at the rear end of the tubes, the height of said slit being 0.7–0.9 mm, the outer ends of said third slit forming the sectional angle of 35°–42° to the plane of the fins and the sectional angle of the inner end of said third slit being 27°–35° to the plane of the fins.

2. A fin of a heat exchanger as claimed in claim 1, wherein said third slit is divided into three portions.

3. A fin of a heat exchanger as claimed in claim 1, wherein said third slit is divided into two portions.

* * * * *